United States Patent [19]

Reinehr et al.

[11] 4,163,078

[45] Jul. 31, 1979

[54] HYDROPHILIC BI-COMPONENT THREADS

[75] Inventors: Ulrich Reinehr, Dormagen; Christian Pieper, Neuss; Peter Kleinschmidt, Dormagen, all of Fed. Rep. of Germany

[73] Assignee: Bayer Aktiengesellschaft, Leverkusen, Fed. Rep. of Germany

[21] Appl. No.: 804,229

[22] Filed: Jun. 7, 1977

[30] Foreign Application Priority Data

Jun. 10, 1976 [DE] Fed. Rep. of Germany ..... 2625908

[51] Int. Cl.[2] ..... D01D 5/06; D01F 8/04; D01F 8/08; D07G 3/04

[52] U.S. Cl. ..... 428/373; 264/178 F; 264/182; 264/210 F; 428/913

[58] Field of Search ..... 428/373

[56] References Cited

U.S. PATENT DOCUMENTS

| | | | |
|---|---|---|---|
| 3,470,060 | 9/1969 | Szitz et al. | 428/373 |
| 3,473,998 | 10/1969 | Spiesterbach et al. | 428/373 |
| 3,515,627 | 6/1970 | Sekiguchi et al. | 428/373 |
| 3,616,183 | 10/1971 | Bradford et al. | 428/373 |
| 3,624,195 | 11/1971 | Nakayama et al. | 428/373 |
| 3,644,609 | 2/1972 | Nakagawa et al. | 428/373 |
| 3,671,619 | 6/1972 | Fitzgerald et al. | 428/373 |
| 3,679,541 | 7/1972 | Dorris et al. | 428/373 |
| 3,846,226 | 11/1974 | Smithey | 428/373 |
| 3,984,515 | 10/1976 | Mommaerts et al. | 428/369 |
| 3,984,601 | 10/1976 | Blickenstaff | 428/373 |
| 4,059,949 | 11/1977 | Lee | 428/373 |
| 4,075,378 | 2/1978 | Anton et al. | 428/373 |

*Primary Examiner*—J. C. Cannon

*Attorney, Agent, or Firm*—Plumley and Tyner

[57] ABSTRACT

The invention relates to a bi-component filament or fibre of a fibre-forming synthetic polymer having a core/sheath structure in at least one component and having a moisture absorption of at least 1.5% at 65% relative atmospheric humidity and at a temperature of 21° C. and a moisture absorption of at least 5% at 90% relative atmospheric humidity and 21° C. and a water-retention-power of at least 10% as well as to a process for the production thereof.

6 Claims, 2 Drawing Figures

HYDROPHILIC BI-COMPONENT THREADS

The invention relates to hydrophilic bi-component fibres and threads of synthetic polymers and a method for producing them.

During the development of synthetic fibres, great efforts were made to combine easy-care, good processability and excellent mechanical/technological properties with the ability to crimp the wool. Articles made from these fibres are distinguished by their clear stitch formation, by good texture, their woollen feel, by their elasticity during mechanical strain and their good recovery. By the development of fibres with bifilar, spiral-shaped, permanent crimping, a raw textile material has been produced which has improved properties of strength and deformation in addition to the advantageous qualities of the wool in relation to these natural fibres.

Structural adjustments such as thickness, pore volume, or permeability to air and handling behaviour play an essential part with regard to comfort when wearing textile articles.

In this connection, the ability of the threads to absorb moisture is a physiological advantage in clothing of textiles which are worn close to the skin.

In addition, there are numerous fields of application, for which only fibres having a strong ability of absorbing water are suitable. This applies to terry articles as well as sportswear or clothing in general which must be in a position to absorb perspiration in liquid form from the skin during increased perspiration as a result of strong physical performance (for example sporting acitivity). These fibres keep the skin relatively dry for longer periods and feel pleasant to wear.

Wool, for example, absorbs from approximately 13 to 15% moisture in a relative air humidity of 65% at 21° C. and it has a water retention capacity of ca. 40%. In the past, it has not been possible to obtain these values in synthetic fibres having bifilar, spiral-shaped, wool-like crimping.

The object of the present invention was, therefore, to provide such bi-component fibres and threads and a method for producing them, which, owing to their moisture absorption and their water retention capacity are an improvement on the formerly known synthetic bi-component fibres.

It has been found that this desired improvement is obtained if a substance having specific properties is added to the solvent for the polymer during a solvent spinning process.

The invention therefore relates to a process for the production of a hydrophilic bi-component filament or fibre from two different fibre-forming, synthetic polymers, which are placed eccentrically to each other in defined areas, according to a solution spinning process, which comprises adding to at least one spinning solution 5 to 50% by weight, based on the solvent and polymeric solid, of a substance which is (a) a non-solvent for the polymers to be spun and (b) readily miscible with the spinning solvent and with water or another liquid used as washing liquid for filaments of fibres so spun.

The production of bi-component fibres is carried out in known manner by means of conjugate spinning of at least two different polymer solutions in a side by side or in a core/sheath structure. Acrylonitrile polymerizates are preferably spun in this way. These polymerizates preferably contain at least 50% by weight, and most preferably at least 85% by weight, of acrylonitrile units.

In addition, they may contain one or several of the copolymerised comonomers which are known in the acrylic fibre industry. Examples of these include acrylic acid and methacrylic acid as well as their derivatives, such as esters, preferably alkylesters, such as (meth)acrylic acid methyl- or ethylester, substituted or unsubstituted amides, such as (meth)acrylamide, N-methyl(meth)acrylamide, N,N-dimethyl (meth)acrylamide, also vinylesters such as vinylacetate. Comonomers with groups which have an affinity for dyes, preferably acid groups, may also be copolymerised. These groups preferably include (meth)allylsulphonic acid, vinylsulphonic acid, styrenesulphonic acid and their salts, preferably alkali metal salts.

In the selection of the polymerizates, which are spun conjugately to each other, care should be taken that the polymerizates are different so that the difference in shrinkage of the individual components in multi-component threads is at least 1%. This may be achieved by means of the comonomer content as described for example in German Auslegeschrift No. 1,494,677 or in U.S. Pat. No. 3,039,524, but the difference should preferably be less than 500 milliequivalents per kg of polymerizate if the two components have different contents of acid groups.

The hydrophilic nature of the fibres may be increased in the application of acrylonitrile polymerizates by adding copolymerizates which contain comonomers with hydrophilic amino-, sulpho-, hydroxyl-N-methylol- or carboxyl-groups. Compounds which are particularly suitable include acrylic acid, methacrylic acid, methallylsulphonic acid, acrylamides and the N-methylol compounds of an unsaturated acid amide, such as N-methylolacrylamide and N-methylolmethacrylamide. Mixtures of polymers may also be used.

Suitable spinning solvents include the solvents which are known in dissolving spinning, particularly dimethylacetamide, dimethylsulphoxide, N-methylpyrrolidone, but preferably dimethylformamide.

If the bifilar threads according to the invention are dry spun in the known standard working manner, the substance which is added to the spinning solvent should preferably have a higher boiling point than the spinning solvent itself. Thus, substances with a boiling point of about 50° C. and more above that of the spinning solvent are preferred.

Such substances include for example the following liquids: mono- and poly-substituted alkylethers and -esters of polyhydric alcohols such as diethyleneglycol-mono- or dimethyl, -ethyl and butylether, diethyleneglycol, triethyleneglycol, tripropyleneglycol, triethyleneglycoldiacetate, tetraethyleneglycol, tetraethyleneglycoldimethylether, glycoletheracetate such as butylglycolacetate. High-boiling alcohols are also suitable such as 2-ethylenecyclohexanol, esters or ketones, or also mixtures from ethyleneglycolacetates for example.

Glycerine is preferably used.

Of course, liquid mixtures may be used in addition to an individual liquid. However, it is important that the liquids added are water-soluble, so that they may be removed during the course of post-treatment of the fibres.

Furthermore, it is advantageous to use liquids which do not form azeotropic mixtures with the spinning solvent used so that they may be almost completely recovered by fractional distillation as in the case of DMF-glycerine or DMF-diethyleneglycol mixtures.

These liquids are added to the spinning solvent in quantities of from 5 to 50, preferably from 10 to 20% by weight based on the solvent and solid. The upper limit of the liquid content to be mixed in is determined in practice by the spinability of the polymer solution. The higher the proportion by weight of liquid added to the spinning solvent, the stronger the porosity in the fibre core and the higher the hydrophilic nature of threads which are produced from spinning dissolving mixtures of this type.

In the case of glycerine, up to about 16% by weight is added to a 17% by weight polyacrylonitrile solution in DMF. In order to obtain thorough mixing of the spinning solution, the spinning solvent, for example DMF, is appropriately mixed with the higher boiling liquid and the well-stirred solution is only then displaced with the polymeric powder, since precipitation is observed during direct addition of glycerine to polyacrylonitrile solutions in DMF.

In order to obtain fibres with the best possible hydrophilic nature according to the method of the invention, the spinning treatment is selected so that as little as possible of the liquid added during the dry spinning process in the spinning duct is evaporated or extracted together with the evaporating spinning solvent. Spinning duct temperatures which are as low as possible and which are scarcely above the boiling point of the spinning solvent to be evaporated, short spinning ducts and high spinning outlets and thus short residence times in the spinning duct have proved to be exceptionally advantageous. For these reasons, the maximum temperature in the spinning duct should be 80° C., preferably 5° to 30° C., above the boiling temperature of the spinning solvent used.

By using these measures, the essential proportion (usually 90%) of the liquid mixed in the silver or in the threads remains. It is only removed in the course of post-treatment by rinsing.

The substance which is added to the spinning solvent may, however, also be a solid (under normal conditions). The same requirements with regard to its physical properties apply in principle to this solid as to the liquid substance, that is, it must be completely miscible with the spinning solvent and with a rinsing liquid preferably water and should have a boiling point or point of sublimation which is above that of the spinning solvent.

Such substances which are solid under normal conditions include, for example, mono- or poly-hydric alcohols, esters or ketones such as hexanediol, 1,6, sugar and its homologues, inorganic or organic salts and acids such as zinc chloride and pyromellite acid.

Mixtures of substances may also be used instead of a single substance in the case of solids. However, it is important that the substances used are readily water-soluble so that they may be removed from the fibre in the course of post-treatment.

If the bifilar fibres according to the invention are spun wet, the substances described for the dry spinning method may also be used here.

In the method according to the invention, it is not necessary for a substance to be added as described to both spinning solutions which are used for the production of a bifilar thread, but advantageously some of this substance is simply added to one of the spinning solutions.

That component of the bicomponent fibre or filament produced according to the invention that is derived from the spinning solution containing the above described non-solvent exhibits a core/sheath structure. If, of course, both spinning solutions contained a non-solvent a bicomponent fibre is obtained both components of which have said core/sheath structure. This does not mean that the bicomponent fibre per se is a core/sheath-fibre having one component as the core and the other as sheat, even if this arrangement of the components in the fibre is possible, too. However, in the context of this invention those bicomponent fibres are preferred, wherein the two components are arranged in a side-by-side position at least one component having said core/-sheath structure.

The hydrophilic nature of the bi-component fibres produced in this way and having a core/sheath structure in at least one component is also influenced by the type and manner of post-treatment.

If, for example, acrylic fibres from a DMF-glycerine mixture after the spinning process according to the invention are stretched in steam or water and only then washed, dried and finished, the original compact coating surface of the fibres or threads becomes strongly microporous by means of diffused glycerine, whereby acrylic fibres with particularly good hydrophilic properties are obtained.

However, if the core/sheath fibres are first washed and then stretched, the compact coating structure remains since the glycerine is rinsed before stretching and the spaces arising from the diffusing glycerine are closed again by the stretching process. Acrylic fibres with a dense coating surface and correspondingly lesser hydrophilic properties are obtained.

The process of rinsing the core/sheath fibres may be carried out at temperatures of up to 100° C. The residence time should be at least 10 seconds, in order to wash out the added substance thoroughly.

It has also proved expedient to keep the strips of fibre or the thread under low tension or at low shrinking allowance during the rinsing process, in order to maximise the removal of the added substance.

The further after-treatment of the strips of fibre or threads may be carried out according to the stages of after-treatment which are usual in industry: preparation—crimping—drying—cutting, wherein the drying conditions of the fibres exercise another influence on the hydrophilic nature.

Drying conditions which are as mild as possible with a maximum of 160° C., preferably 80° to 140° C., and short residence times of a maximum of 1 to 3 minutes in the dryer give core/sheath fibres with very good hydrophilic properties.

According to these methods, bi-component threads and fibres with core/sheath structure in at least one component may be obtained, although these are spun side by side. However, they show the typical eccentric side by side structure internally, which is responsible for the permanent crimping. They have a moisture absorption of at least 1.5% and a water retaining power of at least 10%. These bi-component threads and fibres are another subject of the invention.

The core with these core/sheath structures is microporous, wherein the average pore diameter is a maximum of 1μ. It is generally between 0.5 and 1μ. The surface of the core in a cross-section through the fibre is generally about 70% of the overall cross-sectional surface.

In order to determine the microporous structure, the following material values are experimentally determined:

(1) the true density (so-called helium density), by measuring the volume with helium with a gas comparison density bottle, (2) the apparent density, by measuring the volume in quicksilver at 10 bar over pressure, (3) the specific surface according to the BET-method, by means of $N_2$-adsorption at −196° C.

The porosity (P) is calculated as follows:

$$P(\%) = \frac{\text{true density} - \text{apparent density}}{\text{true density}} \times 100$$

The sheath may be compact or microporous according to the selection of the after-treatment conditions.

The threads and fibres according to the invention have mushroom-, lip-, trilobal- or dumbbell-shaped cross-sections. The cross-sectional shape which predominates depends on the spinning conditions chosen as well as on the quantity of the substance added to the spinning solvent, wherein the last mentioned measure exercises the strongest influence.

The bi-component threads and fibres according to the invention demonstrate good fibre qualities, such as high tensile strength, breaking elongation and good dye absorption as well as the described hydrophilic properties.

In relation to wool, cotton and other natural fibres, these fibres have the advantage, by means of the core/-sheath structure, of producing a relatively dry feeling against the skin when absorbing a lot of water, since the water is essentially taken up by the fibre core.

They also have good crimping properties. The number of crimping bows and the curling are determined according to the standard working regulations (cf. for example F. Strecker: Faserkrauselungen Chemiefasern 1974, page 852). The crimping reversibility Δ c.p.c. (Δ c.p.c. ≙ change in the number of crimping bows per cm) was determined according to U.S. Pat. No. 3,038,236.

$$\Delta\ c.p.c. = \frac{\text{Number of crimping bows (25° C. dry)} - \text{Number of crimping bows (70° C. wet)}}{\text{Length of the crimped fibre}}$$

The crimping of the bi-component threads, once it is developed, is spiral-shaped and long lasting and represents the condition of minimum energy for the threads. It is also permanent and elastic, when interrupted by deformations. If it is extended to tear point by mechanical deformation, it retracts during tension-free heat treatment.

Another very big advantage of the fibres according to the invention with regard to comfort during wear is produced from their core/sheath structure. Whereas natural fibres such as wool feet wet throughout when they absorb a lot of water, this is not the case with the fibres according to the present invention. It is assumed that this is based on the fact that the absorbed water diffuses in the microporous core. Therefore, the fibres do not feel wet towards the outside, which is associated with a comfortable feeling when wearing the fibre.

Although bi-component acrylic threads and the production thereof are predominantly described in the above, the present invention is not restricted thereto. Linear, aromatic polyamides such as the polyamide from m-phenylenediamine and isophthalylchloride or those which optionally still have heterocyclic ring systems, such as polybenzimidazoles—oxazoles—thiazoles etc., and which may be produced according to a dissolving spinning method, may also be used.

Other suitable compounds include polymers having melting points above 300° C., which are generally no longer spinnable from the melt and are produced according to a dissolving spinning method, for example by dry spinning.

The water-retaining power of fibres is an important clothing-physical quantity to be measured. A strong water-retaining power has the effect of keeping textiles which are worn near to the skin relatively dry during increased perspiration build-up and thus improve comfort when wearing them.

Determination of the water-retaining power (WR)

The water-retaining power is determined, based on the DIN-regulation 53814 (cf. Melliand Textilberichte 4 1973, page 350).

The fibre samples were plunged in water containing 0.1 wetting agent. The fibres are then subjected to centrifuge with an acceleration of 10,000 m/sec$^2$ and the quantity of water which is retained in and between the fibres is gravimetrically determined. In order to determine the dry weight, the fibres are dried at 105° C. to moisture constancy. The water-retaining power (WR) in percent by weight is:

$$WR = (m_f - m_{tr}/m_{tr}) \times 100$$

$m_f$ = weight of the moist fibre product
$m_{tr}$ = weight of the dry fibre product.

Determination of the moisture-absorbing power (FA)

The moisture absorption of the fibre is gravimetrically determined based on the dry weight. For this purpose, the samples are subjected to a climate of 21° C. and 65% or 90% relative atmospheric moisture for 24 hours. In order to determine the dry weight, the samples are dried at 105° C. to constant weight. The moisture absorption (FA) in percent by weight is:

$$FA = (m_f - m_{tr}/m_{tr}) \times 100$$

$m_f$ = moist weight of the fibre at 21° C. and 65% or 90% relative moisture
$m_{tr}$ = dry weight of the fibre.

The illustrations represent:

Figure 1:
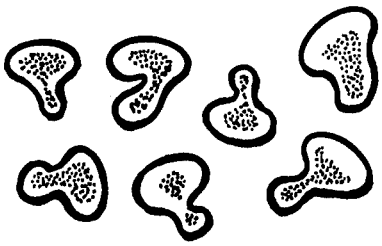
FIG. 1 is a cross sectional view of a fiber under this invention.
Figure 2:
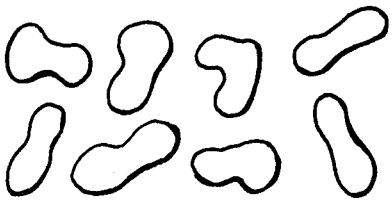
FIG. 2 is a cross sectional view of a fiber not under this invention which is prepared similarly to the fiber of FIG. 1.

More specifically:

FIG. 1 is a drawn representation of a light microscope image at 500× magnification of a cross-section of the fiber of Example 4 which shows a pronounced core/sheath structure and a mushroom cross section;

FIG. 2 is a drawn representation of a light microscope image at 500× magnification of a cross-section of the fiber prepared in accordance with comparative Example 6 which shows a homogeneous cross-section having a dumbbell to mushroom shape.

The following Examples provide a detailed illustration of the invention. Data regarding proportions and percentages are based on the weight unless otherwise stated.

EXAMPLE 1

5.7 kg of an acrylonitrile copolymerizate of 93.6% of acrylonitrile, 5.7% acrylic acid methylester and 0.7% of sodiummethallylsulphonate were dissolved at 90° C. in a mixture of 19.8 kg of dimethylformamide and 4.5 kg of glycerine at 90° C. 7.5 kg of another acrylonitrile copolymerizate mixture, comprising 5.5 kg of acrylonitrile homopolymerizate and 2 kg of an acrylonitrile copolymerizate of 91% of acrylonitrile, 5.6% of acrylic acid methylester and 3.4% of sodium-methallylsulphonate were dissolved in dimethylformamide at 100° C. Both solutions were lead to a bifilar nozzle and dry spun side by side in the ratio 1:1. The fibres were combined in a cable, stretched 1:3.6 fold in boiling water, rinsed, prepared, dried under tension at 110° C., crimped, cut and fixed in steam in 1.5 minutes. The fibres had an individual titre of 3.3 dtex, a strength of 1.9 p/dtex with an elongation of 48%. The fibres possessed a pronounced core/sheath structure with mushroom-shaped cross-section, as shown in light-microscopic images of the cross-sections. The width of the hem of the sheath amounts to approximately 2 μm and is compact in relation to the fine-pored core. The bi-component fibres were spun into Nm 16/4 yarns which were rope dyed for 1 hour in boiling dyeing bath and dried without tension. The moisture absorption of the dyed yarns amounted to 2.0% at 65% relative atmospheric humidity and 21° C., and 9.5% at 90% relative atmospheric humidity and 21° C. The water-retaining power amounted to 26%. Fibres from the yarn had approximately 10 crimping bows per cm and a crimping of 11.2%. The fibres had a crimping reversibility of 0.2, a porosity of 21.4% and a specific surface of 8.8 ($m^2/g$).

The dyed yarns were plump with a wool-like feel.

EXAMPLE 2

A proportion of the fibre cable from Example 1 was dried at 110° C., crimped and cut to piled fibres after allowing shrinkage of 25%. The bi-component fibres had an individual titre of 3.3 dtex, a strength of 2.1 p/dtex and an elongation of 53% with a similar cross-sectional structure. The yarns which were correspondingly produced and dyed had a moisture absorption of 2.1% or 8.1% at 65 or 90% relative atmospheric humidity and a water-retaining power of 20%. Fibres of the yarn had some 12 crimping bows per cm and a crimping of 14.7%. The fibres had a crimping reversibility of 0.3, a porosity of 17.9% and a specific surface of 3.8 ($m^2/g$).

The dyed yarns were very plump and a somewhat harder feel.

EXAMPLE 3

5.3 kg of an acrylonitrile polymerizate mixture, comprising 4.5 kg of acrylonitrile homopolymerizate and 0.8 kg of an acrylonitrile copolymerizate consisting of 91% acrylonitrile, 5.6% acrylic acid methylester and 3.4% of sodium-methallylsulphonate were dissolved at 90° C. in a solution of 20.6 kg of DMF and 4.2 kg of DL-sorbose. 5.3 kg of another acrylonitrile copolymerizate of 93.6% acrylonitrile, 5.7% acrylic acid methylester and 0.7% sodium methallylsulphonate were dissolved at 90° C. in 12.7 kg of DMF. Both solutions were lead to a bifilar nozzle and spun side by side in the ratio 1:1. The threads were combined in a cable, stretched 1:3.6 times in boiling water, rinsed, prepared and dried at 130° C. without tension. The fibres having an individual titre of 4.6 dtex had a strength of 2.1 p/dtex and with an elongation of 42%. The fibres also had a core/sheath structure with mushroom to lip-shaped cross-section. The hem width of the sheath was from 1 to 2 μm. The bi-component fibres had a moisture absorption of 1.9 or 9% at 65 or 90% relative atmospheric humidity and 21° C. The water-retaining power amounted to 36%. The fibres had 12 crimping bows per cm and a crimping of 15.5%. The fibres had a crimping reversibility of 0.2, a porosity of 41% and a specific surface of 13.2 ($m^2/g$).

EXAMPLE 4

5.7 kg of an acrylonitrile copolymerizate of 93.6% of acrylonitrile, 5.7% of acrylic acid methylester and 0.7% of sodium methallylsulphonate were dissolved at 90° C. in a mixture of 19.8 kg of DMF and 4.5 kg of glycerine. 5.3 kg of the similar acrylonitrile copolymerizate were analogously dissolved in 12.7 kg of DMF. The first solution was brought to 80° C. and the second to 100° C., and both solutions were dry spun in a bifilar nozzle side by side in the ratio 1:1. The threads were brought together to a cable, stretched 1:2.5 fold at 75° C., rinsed and dried without tension at 130° C. The fibres having an end titre of 5.3 dtex had 8 crimping bows per cm and a crimping of 10%. The moisture absorption amounted to 1.8% or 7.2% at 65% or 90% relative atmospheric humidity and 21° C. The water-retaining power was 35%. The fibres possess, as shown in the drawn representation of light-microscopic image of the cross-sections in FIG. 1 in 500-fold magnification, a pronounced core/sheath structure with mushroom-shaped cross-section. The hem width of the coating is some 4 μm and is compact in relation to the fine-pored core. The fibres had a crimping reversibility of 0.01, a porosity of 40.5% and a specific surface of 12.4 ($m^2/g$).

EXAMPLE 5

5.3 kg of an acrylonitrile copolymerizate of 93.6% acrylonitrile, 5.7% acrylic acid methylester and 0.7% sodium-methallylsulphonate were dissolved at 90° C. in 13.6 kg of DMF. 5.3 kg of a polymerizate mixture, comprising 4.5 kg of acrylonitrile homopolymerizate and 0.8 kg of an acrylonitrile copolymerizate of 91% of acrylonitrile, 5.6% of acrylic acid methylester and 3.4% of sodium methallylsulphonate were additionally dissolved in 16.3 kg of DMF at 100° C. Both solutions were lead to a bifilar nozzle in the ratio 1:1 and spun side by side and, as described in Example 1, processed to fibres and yarns. The fibres had an individual titre of 3.4 dtex, a strength of 2.3 p/dtex and an elongation of 44%. The fibres possessed a mushroom-shaped cross-section. The moisture absorption of the dyed yarn amounted to 1 or 1.7% at 65 or 90% relative atmospheric humidity and 21° C., and the water-retaining power had a value of 8%. The fibres had some 12 crimping bows per cm and a curling of approximately 7%. The crimping was permanent and remained almost unchanged during water treatment up to boiling temperature. The fibres had a crimping reversibility of 0.02, a porosity of 3.7% and a specific surface of 0.3 ($m^2/g$).

EXAMPLE 6 (Comparison with Example 4)

5.7 kg of the acrylonitrile polymerizate from Example 4 were dissolved once in 13.0 kg of DMF and once in 15.4 kg of DMF at 90° C. The first solution was brought to 120° C. and the second to 80° C., and both solutions were lead into a bifilar nozzle in the ratio 1.31:1 and dry spun side by side. The threads received an after-treatment as described in Example 4. The fibres having an individual titre of 5.5 dtex had 9 crimping bows per cm and a crimping of 11%. The moisture absorption of the fibres amounted to 1 or 2% at 65% or 90% relative atmospheric humidity and 21° C. The water-retaining power had a value of 9%. The fibres possess a dumbbell to mushroom-shaped homogeneous cross-section, as shown in the drawn representations of light microscopic images in FIG. 2. The fibres had a crimping reversibility of 0.05, a porosity of 6.4% and a specific surface of 2.0 ($m^2/g$).

What is claimed is:

1. A bicomponent filament or fiber of two different fiber-forming synthetic polymers in which the two components are eccentric to each other and in which at least one component has a core/sheath structure with a microporous core, and a sheath denser than the core; and in which the bicomponent filament or fiber has a moisture absorption of at least 1.5 at 65% relative atmospheric humidity and 21° C., a moisture absorption of at least 5% at 90% relative atmospheric humidity and 21° C.; and a water-retention power of at least 10%.

2. The bicomponent filament or fiber of claim 1 in which both polymeric components are polymers of acrylonitrile each containing at least 50% by weight of acrylonitrile units.

3. The bicomponent filament or fiber of claim 1, in which said polymer in the component having the core/-sheath structure is an acrylonitrile polymer.

4. The bicomponent filament or fiber of claim 3, in which said acrylonitrile polymer contains at least 50% by weight of acrylonitrile units.

5. The bicomponent filament or fiber of claim 3, in which both polymeric components contain acid groups and the number of the acid groups in the two components differs by less than 250 m val/kg of polymer.

6. The bicomponent filament or fiber of claim 5 in which both polymeric components are copolymers of acrylonitrile and a monomer containing acid groups.

* * * * *